US011759911B2

(12) United States Patent
Zuniga et al.

(10) Patent No.: US 11,759,911 B2
(45) Date of Patent: Sep. 19, 2023

(54) CARRIER HEAD WITH SEGMENTED SUBSTRATE CHUCK

(71) Applicant: Applied Materials, Inc., Santa Clara, CA (US)

(72) Inventors: Steven M. Zuniga, Soquel, CA (US); Jay Gurusamy, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/737,642

(22) Filed: May 5, 2022

(65) Prior Publication Data

US 2022/0258302 A1 Aug. 18, 2022

Related U.S. Application Data

(63) Continuation of application No. 16/688,348, filed on Nov. 19, 2019, now Pat. No. 11,325,223.

(60) Provisional application No. 62/891,207, filed on Aug. 23, 2019.

(51) Int. Cl.
*B24B 37/32* (2012.01)

(52) U.S. Cl.
CPC ..... *B24B 37/32* (2013.01)

(58) Field of Classification Search
CPC ..... B24B 37/32; B24B 37/27; B24B 37/30; B24B 37/04; B24B 37/042
USPC ..... 451/41, 288, 289
See application file for complete search history.

(56) References Cited

U.S. PATENT DOCUMENTS 5,681,215 A 10/1997 Sherwood et al.
5,816,900 A 10/1998 Nagahara et al.
5,964,653 A 10/1999 Perlov et al.
6,050,882 A 4/2000 Chen
6,132,298 A 10/2000 Zuniga et al.
(Continued)

FOREIGN PATENT DOCUMENTS

CN 101484277 7/2009
EP 1177859 2/2002
(Continued)

OTHER PUBLICATIONS

International Search Report and Written Opinion in International Appln. No. PCT/US2020/047478, dated Dec. 1, 2020, 11 pages.

*Primary Examiner* — Don M Anderson
*Assistant Examiner* — Jason Khalil Hawkins
(74) *Attorney, Agent, or Firm* — Fish & Richardson P.C.

(57) ABSTRACT

A carrier head for a chemical mechanical polishing apparatus includes a carrier body, an outer membrane assembly, an annular segmented chuck, and an inner membrane assembly. The outer membrane assembly is supported from the carrier body and defines a first plurality of independently pressurizable outer chambers. The annular segmented chuck supported below the outer membrane assembly, and includes a plurality of concentric rings that are independently vertically movable by respective pressurizable chambers of the outer membrane assembly. At least two of the rings having passages therethrough to suction-chuck a substrate to the chuck. The inner membrane assembly is supported from the carrier body and is surrounded by an innermost ring of the plurality of concentric rings of the chuck. The inner membrane assembly defines a second plurality of independently pressurizable inner chambers and has a lower surface to contact the substrate.

18 Claims, 3 Drawing Sheets

(56) References Cited

U.S. PATENT DOCUMENTS 6,183,354 B1 * 2/2001 Zuniga ..... B24B 37/32 451/287
6,220,944 B1 4/2001 Chen
6,241,593 B1 6/2001 Chen et al.
6,398,621 B1 * 6/2002 Zuniga ..... B24B 37/0053 451/8
6,431,968 B1 * 8/2002 Chen ..... B24B 37/30 451/288
6,447,368 B1 9/2002 Fruitman et al.
6,494,774 B1 12/2002 Zuniga et al.
6,503,134 B2 1/2003 Shendon
6,558,232 B1 5/2003 Kajiwara et al.
6,582,277 B2 6/2003 Korovin et al.
6,623,343 B2 9/2003 Kajiwara et al.
6,652,362 B2 * 11/2003 Boo ..... B24B 37/32 451/41
6,652,368 B2 11/2003 Shendon et al.
6,659,850 B2 * 12/2003 Korovin ..... B24B 37/32 451/286
6,719,618 B2 4/2004 Homma et al.
6,755,726 B2 * 6/2004 Chen ..... B24B 37/30 451/288
6,764,387 B1 7/2004 Chen
6,890,249 B1 5/2005 Zuniga et al.
6,957,998 B2 * 10/2005 Togawa ..... B24B 53/017 451/388
7,029,383 B2 4/2006 Lee
7,074,118 B1 7/2006 Bottema et al.
7,140,956 B1 11/2006 Korovin et al.
7,207,871 B1 * 4/2007 Zuniga ..... B24B 49/16 451/388
7,255,771 B2 * 8/2007 Chen ..... B24B 37/30 156/345.12
7,303,466 B2 12/2007 Boo et al.
7,842,158 B2 11/2010 Chen et al.
8,721,391 B2 5/2014 Chen et al.
8,932,106 B2 1/2015 Fukushima et al.
8,939,815 B2 1/2015 Tsai et al.
11,325,223 B2 5/2022 Zuniga et al.
2005/0037698 A1 2/2005 Zuniga et al.
2006/0199479 A1 9/2006 Togawa et al.
2009/0186560 A1 7/2009 Kordic
2013/0260654 A1 10/2013 Kang
2014/0004779 A1 * 1/2014 Namiki ..... B24B 37/32 451/365
2015/0017889 A1 1/2015 Umemoto et al.
2015/0165587 A1 * 6/2015 Lin ..... B24B 53/02 451/364
2015/0273657 A1 10/2015 Fukushima et al.
2018/0117730 A1 5/2018 Nabeya et al.
2019/0358768 A1 * 11/2019 Kang ..... B24B 37/32

FOREIGN PATENT DOCUMENTS

JP H11-179652 7/1999
JP 2002-079454 3/2002
JP 2015-033759 2/2015

* cited by examiner

CARRIER HEAD WITH SEGMENTED SUBSTRATE CHUCK

CROSS-REFERENCE TO RELATED APPLICATIONS

This application is a continuation of U.S. application Ser. No. 16/688,348, filed on Nov. 19, 2019, which claims priority to U.S. Provisional Application Ser. No. 62/891,207, filed on Aug. 23, 2019, the disclosures of which are incorporated by reference.

TECHNICAL FIELD

This invention relates to a carrier head for use in chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a carrier head for a chemical mechanical polishing apparatus includes a carrier body, an outer membrane assembly, an annular segmented chuck, and an inner membrane assembly. The outer membrane assembly is supported from the carrier body and defines a first plurality of independently pressurizable outer chambers. The annular segmented chuck supported below the outer membrane assembly, and includes a plurality of concentric rings that are independently vertically movable by respective pressurizable chambers of the outer membrane assembly. At least two of the rings having passages therethrough to suction-chuck a substrate to the chuck. The inner membrane assembly is supported from the carrier body and is surrounded by an innermost ring of the plurality of concentric rings of the chuck. The inner membrane assembly defines a second plurality of independently pressurizable inner chambers and has a lower surface to contact the substrate.

In another aspect, a chemical mechanical polishing system includes a platen to support a polishing pad, the carrier head, a plurality of pressure sources coupled to the inner and outer chambers in the carrier head, and a controller coupled to the pressure sources.

In another aspect, a method for chemical mechanical polishing includes placing a substrate into a carrier head, polishing the substrate using pressure from an outer membrane assembly transferred through a substrate chuck of the carrier head and pressure from an inner membrane assembly of the carrier head surrounded by the chuck, and during polishing preventing the substrate from moving laterally by chucking the substrate to the carrier head using the chuck.

Possible advantages may include, but are not limited to, one or more of the following. A segmented substrate chuck can simultaneously position a substrate against a polishing pad and secure the substrate to a carrier head. The chuck can prevent lateral motion of the substrate, thereby preventing or reducing the likelihood of the substrate colliding with a retaining ring. The lifetime of the retaining ring can be extended as the inner surface of the ring incurs less damage due to reduced contact between the substrate and the retaining ring. Additionally, the edge of the substrate can incur less lateral force, so that the substrate is less likely to warp, resulting in a more uniformly polished and desired substrate profile.

DETAILED DESCRIPTION

During polishing, frictional force on a substrate from the polishing pad can drive the substrate into contact with a retaining ring. This can damage the retaining ring, e.g., create scoring marks on the inner surfaces of the wall of the retaining ring due to the contact between the substrate and the retaining ring. The substrate can also chip or shatter as a result of colliding with the retaining ring. Additionally, as a result of the scoring, the edge of the substrate may be driven up off or down onto the polishing pad, changing the pressure distribution on the substrate and resulting in non-uniformity during polishing. Moreover, the retaining ring can require replacement after a certain number of polishing cycles, e.g., before non-uniformity induced by the scoring exceeds permissible limits.

A technique to address one or more of these problems is to chuck the substrate to the carrier head. Chucking the substrate can prevent the substrate from contacting the retaining ring, which can reduce non-uniformity at the edge of the substrate and extend the life of the retaining ring. However, the carrier head can still include a flexible membrane that contacts some portions of the back side of the substrate.

Figure 1A:
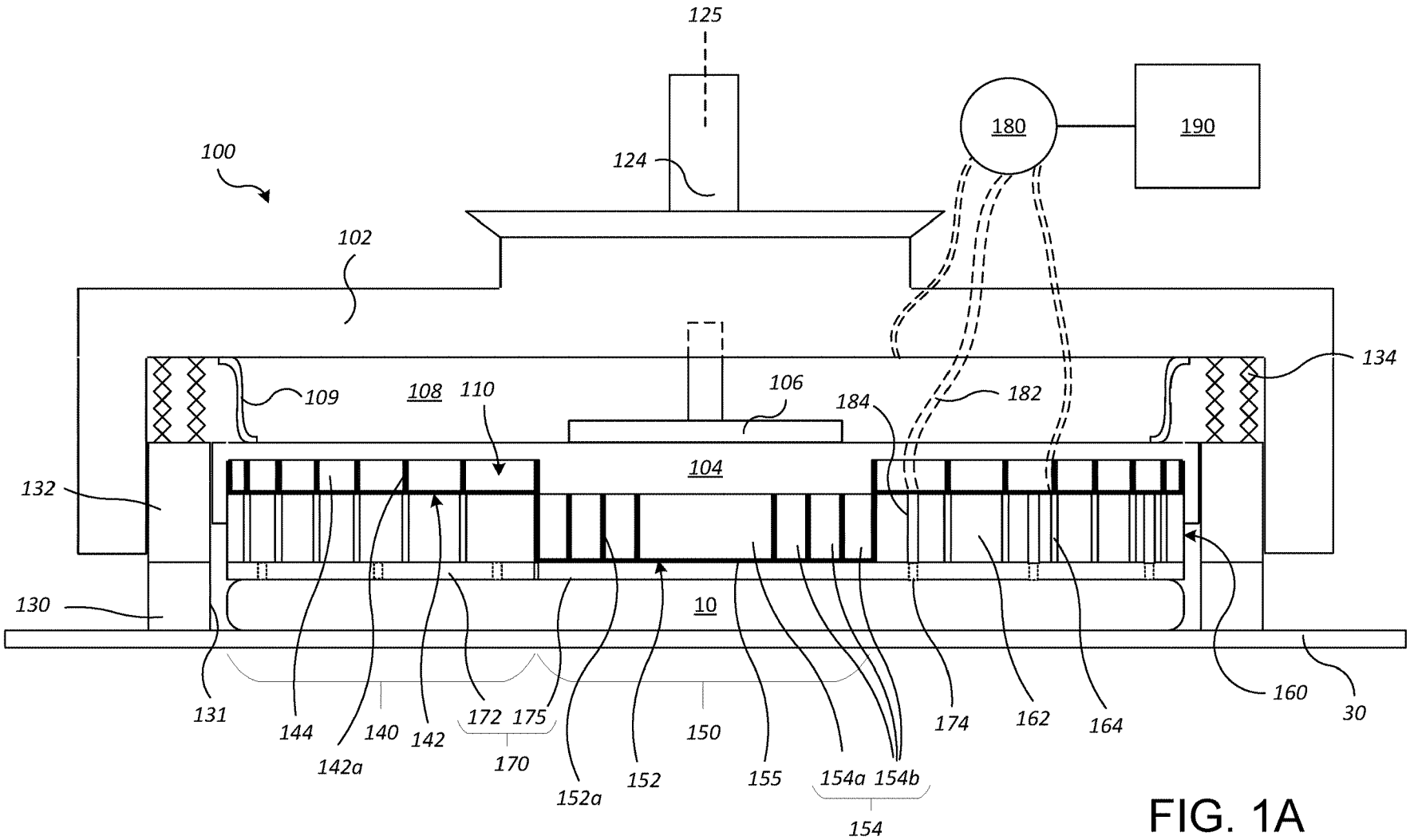
FIG. 1A is a schematic cross-sectional view of a carrier head with a segmented chuck.
Figure 1B:
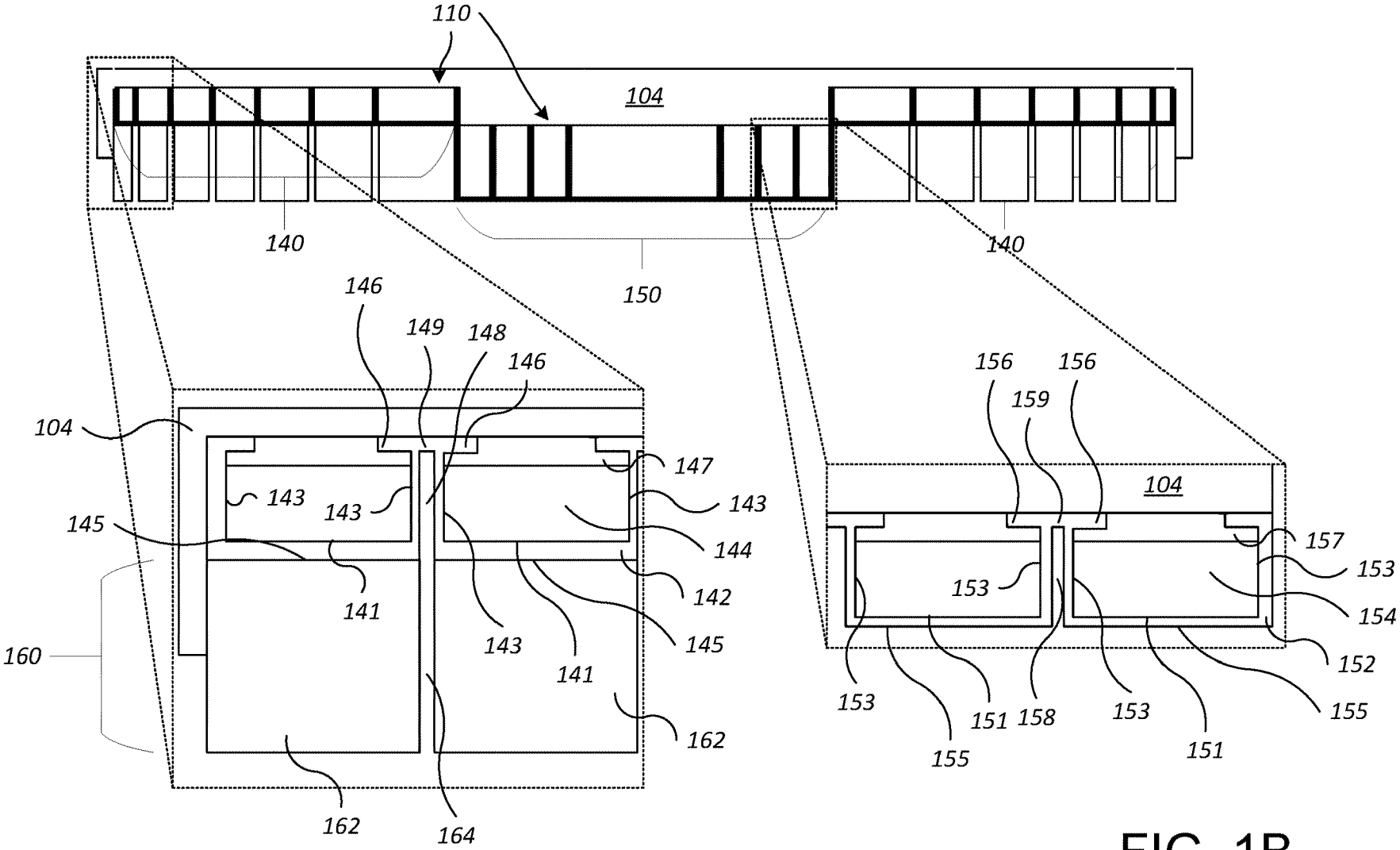
FIG. 1B is a schematic cross-sectional view of the membrane assembly of FIG. 1A.

Referring to FIGS. 1A and 1B, a substrate 10 can be polished by a chemical mechanical polishing (CMP) apparatus that has a carrier head 100.

The carrier head 100 includes a housing 102, a carrier body 104, a gimbal mechanism 106 (which may be considered part of the carrier body 104), and a retaining ring 130.

The housing 102 can generally be circular in shape and can be connected to a drive shaft 124 to rotate therewith during polishing about a central axis 125. There can be passages extending through the housing 102 for pneumatic control of the carrier head 100.

The carrier body 104 is a vertically movable assembly located beneath the housing 102. A loading chamber 108 is located between the housing 102 and the carrier body 104 to apply a load, i.e., a downward pressure or weight, to the carrier body 104. The chamber 108 can be sealed by an annular flexure, rolling diaphragm or bellows 109. The vertical position of the carrier body 104 relative to a polishing pad is also controlled by the loading chamber 108, which is pressurizable to cause the carrier body 104 to move vertically. In some implementations, the vertical position of the carrier head 100 relative to the polishing pad is controlled by an actuator (not illustrated) that can cause the drive shaft 124 to move vertically.

The gimbal mechanism 106 permits the carrier body 104 to gimbal and move vertically relative to the housing 102 while preventing lateral motion of the base assembly 104 relative to the housing 102. However, the gimbal mechanism is optional; the base assembly could be in a fixed inclination relative to the housing 102.

A membrane assembly 110 includes an inner membrane assembly portion 150 and an outer membrane assembly portion 140. The inner membrane assembly portion 150 includes an inner membrane 152 connected to the carrier body 104. The inner membrane 152 may be composed of a thin flexible material, such as a silicon rubber. The inner membrane 150 has a lower surface 155 that provides a substrate mounting surface; the substrate 10 directly contacts the lower surface 155 when loaded into the carrier head 100.

The inner membrane 152 can divide a volume between the carrier body 104 and the lower surface 155 into multiple independently pressurizable inner chambers 154. The pressurizable inner chambers 154 can be arranged concentrically, e.g., around the axis 125. A central inner chamber 154*a* can be circular, and the remaining inner chambers 154*b* can be annular. There can be one to ten individually pressurizable inner chambers 154. Each individually pressurizable inner chamber 154 can be pressurized and depressurized to inflate and deflate independently from the other individually pressurizable inner chambers 154.

In some implementations, the inner membrane 152 can include flaps 152*a* (see FIG. 1A) that divide the volume into individually pressurizable inner chambers 154. Alternatively, in some implementations, each individually pressurizable inner chamber 154 can be defined by a floor 151 and two side wall portions 153 of the inner membrane 152. For each chamber, flange portions 156 can extend inwardly from top edges of the side wall portions 153 and be secured to the carrier body 104 by a clamp 147 (see FIG. 1B). The clamp 147 can be secured to the carrier body 104 by a screw, bolt, or other similar fastener.

The side walls portions 153 of adjacent inner chambers can be connected at their top edges by a bridging portion 159, e.g., coplanar with the flange portions 156. In contrast, below the bridging portion 159, the adjacent side wall portions 153 are separated by a gap 158. The separated side wall portions 153 allow each individually pressurizable inner chamber 154 to expand (and specifically, the floor 151 of each individually pressurizable inner chamber 154 to move vertically) relative to an adjacent individually pressurizable inner chamber 154. Thus, use of separated side walls 153 for the adjacent inner chambers reduces pressure cross-talk between the adjacent zones on the substrate.

The inner membrane assembly portion 150 is surrounded by the outer membrane assembly portion 140. The outer membrane assembly portion 140 includes an outer membrane 142 connected to the carrier body 104. The outer membrane 142 may be composed of a thin flexible material, such as a silicon rubber. The outer membrane 142 divides a volume between the carrier body 104 and the lower surface 145 into a plurality of independently pressurizable outer chambers 144. Each outer chamber 144 controls the pressure on a portion of the substrate chuck 160, e.g., on one of the annular rings 162 of the chuck 160 as discussed below.

The individually pressurizable outer chambers 144 can be annular concentric chambers. There can be two to ten individually pressurizable outer chambers 144. Each individually pressurizable outer chamber 144 can be pressurized and depressurized to inflate and deflate independently from the other outer chambers 144.

In some implementations, the outer membrane 142 includes flaps 142*a* that divides the volume below the carrier base 104 into multiple individually pressurizable outer chambers 144. Alternatively, in some implementations, each individually pressurizable outer chamber 144 can be enclosed by two side walls portions 143 and a floor portion 141 of the outer membrane 142. For each chamber, flange portions 146 can extend inwardly from top edges of the side wall portions 143 and be secured to the carrier body 104 by a clamp 147 (see FIG. 1B). The clamp 157 can be secured to the carrier body 104 by a screw, bolt, or other similar fastener.

The side walls portions 143 of adjacent outer chambers can be connected at their top edges by a bridging portion 149, e.g., coplanar with the flange portions 146. In contrast, below the bridging portion 149, the adjacent side wall portions 143 are separated by a gap 148. The separated side wall portions 143 allow each individually pressurizable outer chamber 144 to expand (and specifically, the floor portion 141 of each individually pressurizable outer chamber 144 to move vertically) relative to an adjacent outer chamber 144. Thus, use of separated side walls 143 for the adjacent outer chambers 144 reduces pressure cross-talk between the adjacent zones on the substrate. In some implementations, the inner membrane 152 and the outer membrane 142 are portions of a single unitary membrane.

During a polishing operation, the individually pressurizable chambers 144 and 154 can be pressurized to inflate and increase the polishing rate on a portion of the substrate 10 underlying the individually pressurizable chamber 144 or 154. Similarly, the individually pressurizable chamber 144 or 154 can be depressurized to deflate and decrease the polishing rate on the portion of the substrate 10 underlying the individually pressurizable chamber 144 or 154.

Below the outer membrane assembly portion 140 and surrounding the inner membrane assembly portion 150 is the segmented substrate chuck 160. The chuck 160 can be composed of aluminum, stainless steel, a ceramic or plastic. The chuck 160 can include a plurality of concentric annular rings 162. The annular rings 162 can be concentric with the axis of rotation 125 of the carrier head 100. There can be an equal number of annular rings 162 and outer chambers 144. Each annular rings 162 of the chuck 160 can be positioned below a respective outer chamber 144. Thus, as each outer chamber 144 inflates or deflates, that chamber 144 causes the underlying annular ring 162 to move vertically and apply increased or decreased pressure on the substrate 10.

Between the adjacent annular rings 162 are channels 164, e.g., annular gaps. The channels 164 can be connected to a pressure source 180 (discussed further below). The pressure source 180 can blow polishing byproducts (e.g., polishing slurry, particulates) out from between the annular rings 162.

Because the chuck 160 underlies the outer membrane assembly portion 140, the membrane 142 does not contact the substrate 10, and does not incur increased wear and tear due to contact with the substrate 10 during polishing operations.

Below the chuck 160, and optionally below the inner membrane portion 150 as well, can be a cushion 170. The cushion 170 can be composed of a compressible material, e.g., a rubber, e.g., silicone, ethylene propylene diene terpolymer (EPDM) or fluoroelastomer, or a porous polymer sheet. The cushion 170 can include a portion 172 below the annular rings 162 of the chuck and a portion 175 below the inner membrane 152.

One or more vacuum channels 174 are formed through the cushion 170. In particular, the channels 174 can be formed through the cushion in regions below the annular rings 172. The vacuum channels 174 can be connected to the pressure source 180 via passages 182 to modulate the pressure in the vacuum channels 174. A portion of each passage 182 can be provide by a conduit 184 that run through the annular ring 162 of the chuck 160 (the remainder of the passage 182 is illustrated schematically for simplicity, but can include conduits through other solid parts and hoses through the chambers). For example, the pressure source 180 can create a vacuum in the vacuum channels 174 that can hold the substrate 10 to the cushion 170.

The cushion 170 can underlie the chuck 160 and the inner membrane assembly portion 150 to address non-uniformity caused by the chuck 160 and the inner membrane assembly portion 150. The gaps between the annular rings 162 and the gaps 158 between the individually pressurizable chambers 154 do not apply pressure, and consequently can result in local non-uniformities in the applied pressure. However, the cushion 170 can span the gaps between the annular rings 162 and the gaps 158. As such, the cushion 170 can distribute the pressure applied on a portion of the substrate 10 to smooth over the non-uniformity that would occur on the portions of the substrate 10 that underlie the gap between the annular rings 162 and the gap 158 between the individually pressurizable chambers 154.

Alternatively, the cushion 170 could be composed of individual annular rings, with each ring of the cushion 170 separated from an adjacent ring by a gap and secured to the bottom of a respective annular ring 162 of the chuck 160. The cushion 170 can also include a central region 175 that spans the inner membrane portion 150.

A retaining ring 130 can surround the membrane assembly 100 and the substrate 10 and can serve as a pressure control ring. The retaining ring 130 can be connected to an actuator 134, e.g., a pressurizable chamber or bellows. The actuator 134 can cause the retaining ring 130 to move vertically. For example, the actuator 134 can cause the retaining ring 130 to be held against the polishing pad 30 during a polishing operation. The retaining ring 130 is configured to enclose the substrate 10 on the polishing pad 30 without contacting the substrate 10, as the substrate 10 is held in place within the retaining ring 130 by the chuck 160. This can increase the lifetime of the retaining ring 130—the substrate 10 and the retaining ring 130 can incur less damage due to the reduced contact of the substrate 10 being held in place within, and not against, the retaining ring 130.

The vacuum pressure holding the substrate 10 to the cushion 170 can prevent lateral movement of the substrate 10 within the carrier head 100. As a result, the edge of the substrate 10 is less likely to be damaged due to the effect of collision contact between the substrate 10 and the retaining ring 130. Similarly, the inner surface of the retaining ring 130 incurs less damage due to the reduced contact between the substrate 10 and the retaining ring 130. Additionally, as the retaining ring 130 incurs less damage from the substrate 10, the retaining ring 130 can have an increased lifespan before requiring replacement. Moreover, the edge of substrate 10 is less likely to be urged upward or downward due to contact with the retaining ring 130, so polishing can be more uniform, particularly near the edges of the substrate. Further, because the cushion 170 is between the substrate 10 and the inner membrane assembly portion 150, the membrane 152 does not incur increased wear and tear due to contact with the substrate 10 during polishing operations.

A controller 190 can be connected to the pressure source 180. The pressure source 180 can be, for example, a pump, a facilities air or vacuum supply line with associated valves, etc. The pressure source 180 can be connected to the loading chamber 108, the channels 164, and the vacuum channels 174 to increase or decrease their pressures. For example, the controller 190 can control the pressure source 180 to pressurize the loading chamber 108 to move the carrier body 104 down toward the polishing pad 30, or depressurize to create a vacuum in the vacuum channels 174 to mount the substrate 10 to the cushion 170.

Figure 2:
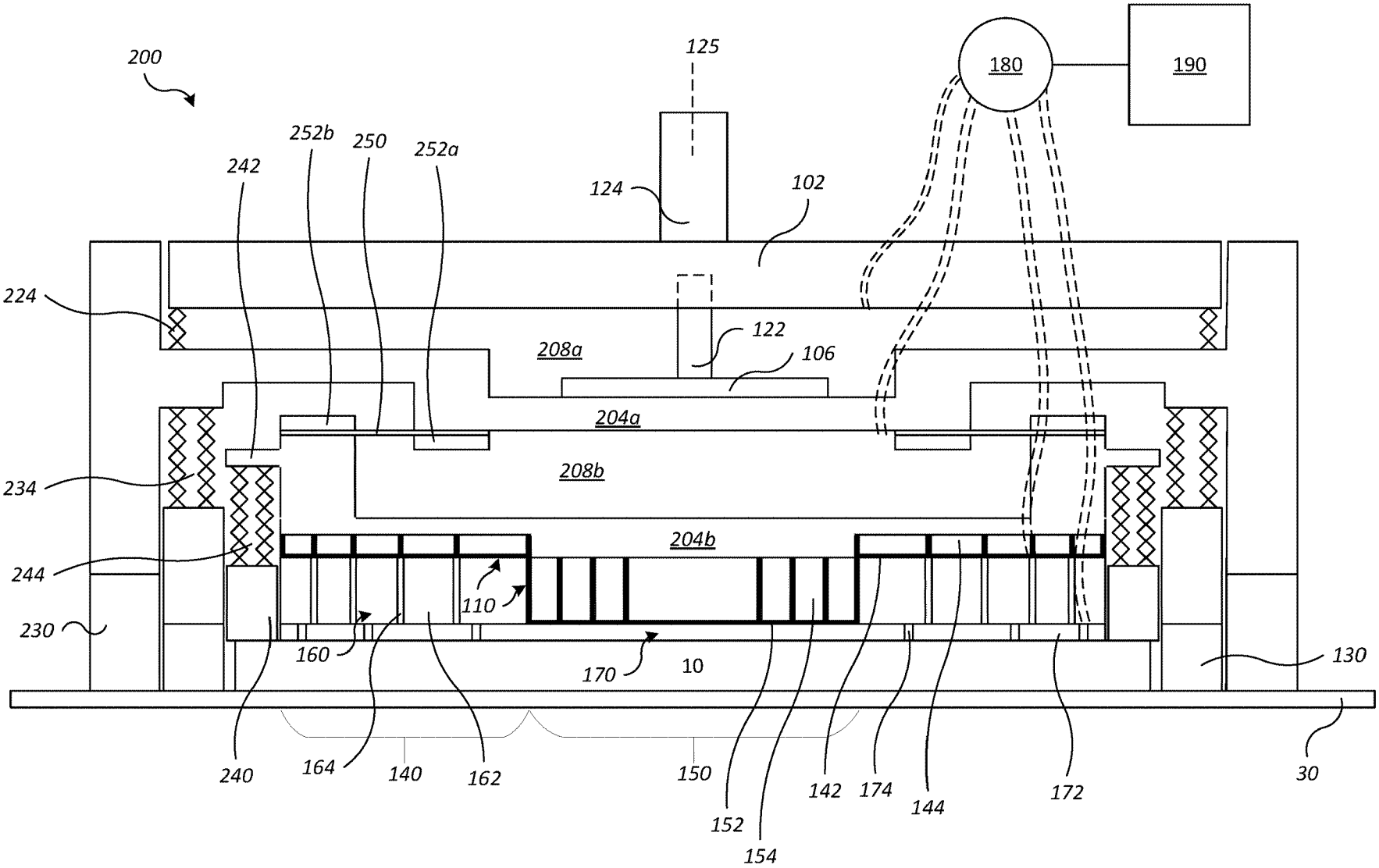
FIG. 2 is a schematic cross-sectional view of a carrier head with a segmented chuck and floating membrane assembly.

Referring to FIG. 2, a carrier head 200 includes the housing 102, an upper carrier body 204*a*, a lower carrier body 204*b*, the retaining ring 130, and an outer ring 230. The carrier head 200 is similar to the carrier head 100, except as noted below.

The upper carrier body 204*a* is a vertically movable assembly located beneath the housing 102. An upper loading chamber 208*a* is located between the housing 102 and the upper carrier body 204*a* to apply a load, i.e., a downward pressure or weight, to the upper carrier body 204*a*. The vertical position of the upper carrier body 204*a* relative to the polishing pad 30 is controlled by the upper loading chamber 208*a*, which is pressurizable to cause the upper carrier body 204*a* to move vertically. The upper loading chamber 208*a* can be sealed by an annular flexure, rolling diaphragm or bellows 224 that extends between the housing 102 and the upper carrier body 204*a*.

Similarly, the lower carrier body 204*b* is a vertically movable assembly located beneath the upper carrier body 204*a*. A lower loading chamber 208*b* is located between the upper carrier body 204*a* and the lower carrier body 204*b* to apply a load, i.e., a downward pressure or weight, to the lower carrier body 204*b*. The vertical position of the lower carrier body 204*b* relative to a polishing pad is also controlled by the lower loading chamber 208*b*, which is pressurizable to cause the lower carrier body 204*b* to move vertically. The controller 190 can increase and decrease the pressures in the upper loading zone 208*a* and the lower loading zone 208*b* by regulating the pressure source 180.

The upper carrier body 204*a* and the lower carrier body 204*b* can move independently of each other, e.g., as dictated by the pressures in the upper loading chamber 208*a* and the lower loading chamber 208*b*. The lower loading chamber 208*a* can be sealed by an annular flexure, rolling diaphragm or bellows 250 that extends between the upper carrier body 204*a* and the lower carrier body 204*b*.

For example, a diaphragm 250 can permit vertical movement of the upper carrier body 204*a* and the lower carrier body 204*b* by flexibly connecting the upper carrier body 204*a* to the lower carrier body 204*b*. The diaphragm 250 can be a flexible and impermeable material, e.g., rubber. The diaphragm 250 can be secured to the upper carrier body

204*a* and lower carrier body 204*b* using anchors 252*a* and 252*b*. The inner edge of the diaphragm 250 can be clamped between the anchor 252*a* and the upper carrier body 204*a*. A fastener such as a bolt, screw, or other similar fastener can be used to secure the anchor 252*a* to the upper carrier body 204*a*. Similarly, the outer edge of the diaphragm 250 can be clamped between the anchor 252*b* and the lower carrier body 204*b*. A fastener such as a bolt, screw, or other similar fastener can be used to secure the anchor 252*b* to the lower carrier body 204*b*.

In some implementations, the vertical position of the upper carrier body 204*a* and lower carrier body 204*b* relative to the polishing pad is controlled by an actuator (not illustrated) that can cause the shaft 122 to move vertically.

The annular retaining ring 130 can be connected to an actuator and/or a bellows 234. The actuator and/or bellows 234 can cause the retaining ring 130 to move vertically. For example, the actuator and/or bellows 234 can cause the retaining ring 130 to be held against the polishing pad 30 during a polishing operation. The retaining ring 130 is configured to enclose the substrate 10 on the polishing pad 30 without contacting the substrate 10, as the substrate 10 is held in place within the retaining ring 130 by the chuck 160.

An outer ring 230 can enclose the retaining ring 130. The outer ring 230 can be connected to the upper carrier body 204*a* by a fastener, such as a bolt, screw, or other similar fastener. The outer ring 230 provides positioning or referencing of the carrier head 200 to the surface of the polishing pad 30.

Surrounding the chuck 160 is an edge-control ring 240. The edge-control ring 240 is decoupled from the lower loading chamber 208*b*, and can be connected to the lower carrier body 204*b*. For example a rolling diaphragm or bellows 244 can be positioned between the edge control ring 240 and a lip 242 that extends from the lower carrier body 204*b*. The edge-control ring 240 is positioned over the edge of the substrate 10 to polish the edge of the substrate 10 independently, to enable focused edge loading to control polishing of the edge of the substrate 10 that surrounds the area on the substrate 10 controlled by the chuck 160.

The controller and other computing devices part of systems described herein can be implemented in digital electronic circuitry, or in computer software, firmware, or hardware. For example, the controller can include a processor to execute a computer program as stored in a computer program product, e.g., in a non-transitory machine readable storage medium. Such a computer program (also known as a program, software, software application, or code) can be written in any form of programming language, including compiled or interpreted languages, and it can be deployed in any form, including as a standalone program or as a module, component, subroutine, or other unit suitable for use in a computing environment.

While this document contains many specific implementation details, these should not be construed as limitations on the scope of any inventions or of what may be claimed, but rather as descriptions of features specific to particular embodiments of particular inventions. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

A number of embodiments of the invention have been described. Nevertheless, it will be understood that various modifications may be made without departing from the spirit and scope of the invention. Accordingly, other implementations are within the scope of the following claims.

What is claimed is:

1. A carrier head for a chemical mechanical polishing apparatus, the carrier head comprising:

a housing;

a first carrier body supported from the housing, the first carrier body vertically movable relative to the housing;

an outer membrane assembly suspended from the first carrier body and defining a first plurality of individually pressurizable outer chambers;

a plurality of concentric rings that are individually vertically movable by respective pressurizable chambers of the outer membrane assembly to apply pressure to an outer portion of a substrate, each concentric ring spaced apart from adjacent concentric rings by a gap which is narrower than the adjacent concentric rings; and an inner membrane assembly suspended from the first carrier body, the inner membrane assembly surrounded by an innermost ring of the plurality of concentric rings, the inner membrane assembly defining a second plurality of individually pressurizable inner chambers and having a lower surface to apply pressure to a central portion of the substrate surrounded by the outer portion of the substrate, wherein the concentric rings are less flexible than the inner and outer membrane assemblies.

2. The carrier head of claim 1, further comprising a retaining ring suspended from and vertically movable relative to the housing and individually vertically movable relative to the first carrier body.

3. The carrier head of claim 1, further comprising a second carrier body supported from and vertically movable relative to the housing, wherein the first carrier body is supported from and vertically movable relative to the second carrier body.

4. The carrier head of claim 3, further comprising an edge-control ring surrounding and vertically movable relative to an outermost ring of the plurality of concentric rings.

5. The carrier head of claim 4, wherein the edge-control ring is supported by and vertically movable relative to the first carrier body.

6. The carrier head of claim 3, further comprising a first retaining ring supported from and vertically fixed to the second carrier body.

7. The carrier head of claim 6, further comprising a second retaining ring supported from and vertically movable relative to the second carrier body, the first retaining ring surrounding the second retaining ring.

8. The carrier head of claim 3, further comprising a retaining ring supported from and vertically movable relative to the second carrier body.

9. The carrier head of claim 1, further comprising a retaining ring supported from and vertically movable relative to the first carrier body.

10. The carrier head of claim 1, further comprising a cushion extending below and secured to the plurality of concentric rings and configured to contact the substrate.

11. The carrier head of claim 10, wherein the cushion is comprised of concentric rings.

12. The carrier head of claim 10, wherein the cushion spans a gap between adjacent concentric rings of the plurality of concentric rings.

13. The carrier head of claim 10, wherein the cushion extends below the inner membrane assembly.

14. The carrier head of claim 13, wherein the cushion spans multiple individually pressurizable chambers of the inner membrane assembly.

15. The carrier head of claim 1, wherein the inner membrane assembly includes an inner membrane having a plurality of flaps to divide a volume below the first carrier body into the second plurality of individually pressurizable inner chambers.

16. The carrier head of claim 15, wherein the outer membrane assembly includes an outer membrane having a plurality of flaps to divide a volume below the first carrier body into the first plurality of individually pressurizable outer chambers.

17. The carrier head of claim 16, wherein the inner membrane and outer membrane are portions of a unitary membrane.

18. A chemical mechanical polishing system, comprising:

a platen to support a polishing pad;

a carrier head including a housing, a first carrier body supported from the housing, the first carrier body vertically movable relative to the housing, an outer membrane assembly suspended from the first carrier body and defining a first plurality of individually pressurizable outer chambers, a plurality of concentric rings that are individually vertically movable by respective pressurizable chambers of the outer membrane assembly to apply pressure to an outer portion of a substrate, each concentric ring spaced apart from adjacent concentric rings by a gap which is narrower than the adjacent concentric rings, and an inner membrane assembly suspended from the first carrier body, the inner membrane assembly surrounded by an innermost ring of the plurality of concentric rings, the inner membrane assembly defining a second plurality of individually pressurizable inner chambers and having a lower surface to apply pressure to a central portion of the substrate surrounded by the outer portion of the substrate, wherein the concentric rings are less flexible than the inner and outer membrane assemblies;

a pressure source coupled to the inner chambers and the outer chambers; and a controller connected to the pressure source.

* * * * *